United States Patent [19]

Sato et al.

[11] Patent Number: 4,783,940

[45] Date of Patent: Nov. 15, 1988

[54] CONCRETE FILLED STEEL TUBE COLUMN AND METHOD OF CONSTRUCTING SAME

[75] Inventors: Takanori Sato; Yasukazu Nakamura; Hideo Nakajima; Yasushi Watanabe; Yoshihiro Orito; Toru Ito; Yutaka Saito, all of Tokyo, Japan

[73] Assignee: Shimizu Construction Co., Ltd., Tokyo, Japan

[21] Appl. No.: 946,713

[22] Filed: Dec. 24, 1986

[30] Foreign Application Priority Data

Dec. 28, 1985 [JP] Japan ..... 60-299530
Jan. 20, 1986 [JP] Japan ..... 61-9695
Jan. 21, 1986 [JP] Japan ..... 61-10882

[51] Int. Cl.[4] ..... E04C 3/10

[52] U.S. Cl. ..... 52/223 R; 52/725; 264/228

[58] Field of Search ..... 52/223 R, 725, 224, 52/223 L; 264/228; 405/257

[56] References Cited

U.S. PATENT DOCUMENTS 836,673 11/1906 Ford .
1,190,002 7/1916 Picuri .
1,432,192 10/1922 Lally ..... 52/725 X
1,571,091 1/1926 Lally ..... 52/725 X
2,176,007 10/1939 Heanue .
2,698,519 1/1955 Lloyd .
3,058,264 10/1962 Varlonga .
3,382,680 5/1968 Takano .
3,793,794 2/1974 Archer et al. .
3,828,504 8/1974 Egerborg et al. .
3,963,056 6/1976 Shibuya et al. .
3,991,532 11/1976 Buxbom .
4,016,701 4/1977 Beynon .
4,018,055 4/1977 Le Clercq ..... 405/257
4,166,347 9/1979 Pohlman et al. ..... 52/725 X
4,281,487 8/1981 Koller .
4,407,106 10/1983 Beck .
4,694,622 9/1987 Richard ..... 264/228 X

FOREIGN PATENT DOCUMENTS 2723534 12/1978 Fed. Rep. of Germany .
1540495 8/1978 France .

*Primary Examiner*—Carl D. Friedman
*Attorney, Agent, or Firm*—Scully, Scott, Murphy & Presser

[57] ABSTRACT

A concrete filled steel tube column which includes: a steel tube connected to beams of a structure so that an axial compressive load is transferred from the beams to the steel tube; and a concrete core, disposed within the steel tube, for bearing an axial compressive load transferred from the beams via the steel tube to the concrete core. The steel tube has a plurality of prestressed tube pieces concentrically joined in series. Each of these tube pieces has an axial prestress introduced into it to counteract a stress resulting from the compressive load applied to the steel tube. With this arrangement, substantially no axial stress is induced in the steel tube. In constructing the column, a steel tube piece is erected, and beams are joined to the tube piece. An axial tensile load is applied to the tube piece so that an axial stress is induced in the tube piece. After the application of the load, concrete is charged into the tube piece. After the concrete is cured, the tensile load is released from the tube piece so that the concrete core is subjected to an axial compression as a reaction to the application of an axial tension to the tube piece. Another tube piece is coaxially joined to an upper end of the concrete filled tube piece. Thereafter, the above-mentioned steps from the beam-joining step to the tube piece-joining step are repeated a plurality of times.

21 Claims, 7 Drawing Sheets

CONCRETE FILLED STEEL TUBE COLUMN AND METHOD OF CONSTRUCTING SAME

BACKGROUND OF THE INVENTION

This invention relates to a concrete filled steel tube column and the method of constructing the same, the concrete filled steel tube column constituting, for example, a part of a building structure such as a column and a pile.

A conventional concrete filled steel tube column is a structural column made of a steel tube having a concrete core within it. In this type of column, it is expected that the steel tube enhances the concrete core in axial compressive strength by its lateral confinement.

The above-mentioned type of steel tube column is constructed by carrying out following steps:

First, a steel tube piece is erected at a construction site;

Second, beams are joined to the erected tube piece at a predetermined level;

Third, concrete is charged into the tube piece to form a core within the tube piece;

After the charged concrete is cured, another tube piece is concentrically joined to the upper end of the tube piece having the core in it; and Thereafter, the fore-mentioned steps are repeated in the same order.

In a column constructed according to the above steps, the tube pieces, which are joined in series, i.e., a steel tube is bonded to the concrete core. Therefore, the steel tube and the core move in singular alignment when axial compression is applied to the column. When the concrete column is subjected to an axial compression beyond a predetermined compressive strength, excess strains develop in the steel tube and the concrete core, resulting in a local buckling in the steel tube or in that the steel tube reaches an yield area under Mieses's yield condition. Thus, the steel tube does not provide the concrete core with sufficient confinement even though the steel tube still has enough circumferential tensile strength, which causes the concrete core to reach a downward directed area of the stress-strain curve at a load applied considerably lower than a predetermined load. For this reason, it cannot be expected to efficiently enhance the concrete core in compressive strength by the lateral confinement of the steel tube hence, a relatively large cross-sectional area must be given to the concrete filled steel tube column to provide sufficient strength for it.

SUMMARY OF THE INVENTION

Accordingly, it is an object of the present invention to provide a concrete filled steel tube column and a method of constructing same which efficiently enhance the compressive strength of the core thereby enabling a considerable reduction in the cross-section thereof in comparison with the prior art column.

Another object of the present invention is to provide a concrete filled steel tube column and a method of constructing same which enable the column itself to have axial compressive and tensile strength resistant to a short-time loading caused, for example, by an earthquake, and thus effectively enhancing the building in rigidity.

With these and other objects in view, one aspect of the present invention is directed to a concrete filled steel tube column including: a steel tube connected to beams of a structure so that an axial compressive load is transferred from the beams to the steel tube; and a concrete core, disposed within the steel tube, for bearing an axial compressive load transferred from the beams via the steel tube to the concrete core. The steel tube comprises a plurality of prestressed tube pieces concentrically joined in series. Each of these tube pieces has an axial prestress introduced into it to counteract a stress resulting from the compressive load applied to the steel tube. With this arrangement, substantially no axial stress is induced in the steel tube.

It is preferred that each of the tube pieces has load transfer means, mounted on its inner face, for transferring the axial load between the steel tube and the concrete core. It is also preferable that in order to introduce the prestress into the tube pieces, the concrete core is under an axial compression as a reaction to the application of an axial tension to the tube pieces.

The load transfer means may consist of a plurality of projection members which project radially inward from the inner face of the corresponding tube piece. Also, the load transfer means may comprise an inner flange circumferentially formed on the inner face of the tube piece. In this case, it is preferable that each of the tube pieces has a joint portion to which the beams of the structure are joined and that the inner flange is formed at the joint portion. The column may have a separating layer interposed between the steel tube and the concrete core, for separating the core from the steel tube so that the steel tube is not bonded to the core.

Another aspect of the present invention is directed to a concrete filled steel tube piece for use in structural columns, the concrete filled steel tube piece comprising a steel tube piece having an axial prestress introduced into it, and a concrete core disposed within the tube piece. The concrete core is under an axial compression as a reaction to the application of an axial tension to the tube piece to introduce the prestress into the tube piece.

Preferably, the tube piece has load transfer means, mounted on its inner face, for transferring the axial load between the tube piece and the concrete core. The load transfer means may be a plurality of projection members which project radially inward from the inner face of the tube piece.

A further aspect of the present invention is directed to a method of constructing a concrete filled steel tube column. A steel tube piece is prepared. The tube piece is erected. After the erecting of the tube piece, beams are joined to the tube piece. An axial tensile load is applied to the tube piece so that an axial stress is induced in the tube piece. After the application of the load, concrete is charged into the tube piece to form a concrete core within the tube piece. After the charged concrete is cured, the tensile load is released from the tube piece so that the concrete core is subjected to an axial compression as a reaction to the application of an axial tension to the tube piece, whereby the stress induced in the tube piece remains in the tube piece as an axial prestress. Another steel tube piece is prepared. Said another tube piece is coaxially joined to an upper end of the concrete filled tube piece. Thereafter, the above-mentioned steps from the beam-joining step to the tube piece-joining step are repeated a plurality of times, whereby the prestress in each of the tube pieces counteracts a stress resulting from a compressive load exerted on the tube piece by the joined tube pieces, this resulting in the construction of a concrete filled steel tube column in which the steel tube has substantially no axial stress.

A still further aspect of the present invention is directed to another method of constructing a concrete filled steel tube column. A plurality of concrete filled steel tube pieces, each including a steel tube piece having an axial prestress introduced into it, and a concrete core disposed within the tube piece, are prepared. One of the concrete filled tube pieces are erected. Beams of the structure are joined to the erected concrete filled tube piece. Subsequently, another concrete filled tube piece is coaxially joined to an upper end of the concrete filled tube piece to which the beams are joined. Then, the fore-mentioned steps from the beam-joining step to the tube piece-joining step are repeated a plurality of times, whereby the prestress in each of the tube pieces counteracts a stress resulting from a compressive load exerted on the tube piece by the joined concrete filled steel tubes, resulting in the construction of a concrete filled steel tube column in which the steel tube has substantially no axial stress.

A still further aspect of the present invention is directed to another method of constructing a concrete filled steel tube column. A steel tube piece is prepared. A separating layer is formed on an inner face of the tube piece so that the tube piece is not bonded to concrete that is to be charged into the tube piece. The tube piece is erected. After the erecting of the tube piece, beams of the structure are joined to the tube piece. A ring-shaped gap is formed in the tube piece so that an upper portion of the tube piece is separated from a lower portion of the tube piece. After the formation of the separating layer and the erecting of the tube piece, the concrete is charged into the tube piece to form a concrete core within the tube piece, whereby the tube piece is axially slidable relative to the concrete core. Another steel tube piece is prepared. A separating layer is formed on an inner face of said another tube piece so that the tube piece is not bonded to concrete that is to be charged into the tube piece. After the charged concrete is cured, said another tube piece is coaxially joined to an upper end of the concrete filled tube piece. The fore-mentioned steps from the beam joining step to the tube joining step are repeated a plurality of times, whereby the concrete core is subjected to an axial compressive load, thereby reducing its axial length, resulting in a downward sliding movement of the tube pieces that eliminates the ring-shaped gaps in the tube pieces. Finally, the upper portion of each of the tube pieces is joined together with the lower portion of the corresponding tube piece, whereby there is constructed a concrete filled steel tube column in which the steel tube has substantially no axial stress.

A still further aspect of the present invention is directed to another method of constructing a concrete filled steel tube column. A steel tube piece is prepared. A separating layer is formed on an inner face of the tube piece so that the tube piece is not bonded to concrete that is to be charged into the tube piece. The tube piece is erected on a foundation with its lower end spaced apart from the foundation so that a ring-shaped gap is formed between the lower end of the tube piece and the foundation. After the erecting of the tube piece, beams of the structure are joined to the tube piece. After the formation of the separating layer and the erecting of the tube piece, the concrete is charged into the tube piece to form a concrete core within the tube piece, whereby the tube piece is axially slidable relative to the concrete core. Another steel tube piece is prepared. A separating layer is formed on an inner face of said another tube piece so that the tube piece is not bonded to concrete that is to be charged into the tube piece. After the charged concrete is cured, said another tube piece is coaxially placed on the concrete filled tube piece with the adjacent ends of both the tubes spaced apart so that a ring-shaped gap is formed between their adjacent ends. After the placement of said another tube piece, the above-mentioned steps from the beam joining step to the tube placement step are repeated a plurality of times, whereby the concrete core is subjected to an axial compressive load, thereby reducing its axial length, resulting in a downward sliding movement of the tube pieces which eliminates the ring-shaped gaps. Finally, all the tube pieces are joined in series and the lowermost tube piece is joined with the foundation, whereby there is constructed a concrete filled steel tube column in which the steel tube has substantially no axial stress.

A still further aspect of the present invention is directed to another method of constructing a concrete filled steel tube column. A steel tube piece is prepared. A separating layer is formed on an inner face of the tube piece so that the tube piece is not bonded to concrete that is to be charged in to the tube piece. The tube piece is erected. After the erecting of the tube piece, beams of the structure are joined to the tube piece. A ring-shaped gap is formed in the tube piece so that the upper portion of the tube piece is separated from the lower portion of the tube piece. After the formation of the separating layer and the erecting of the tube piece, the concrete is charged into the tube piece to form a concrete core within the tube piece, whereby the tube piece is axially slidable relative to the concrete core. After the charged concrete is cured, an axial tensile load is applied to the tube piece by pulling both the upper and lower portions of the tube piece toward each other to eliminate the ring-shaped gap, whereby an axial stress is induced in the tube piece. After the application of the tensile load, the upper portion of the tube piece is joined with the lower portion of the tube piece so that the stress induced in the tube piece remains in the tube piece as an axial prestress. Another steel tube piece is prepared. A separating layer is formed on an inner face of said another tube piece so that the tube piece is not bonded to concrete that is to be charged in to the tube piece. After the joining of the upper and lower portion, said another tube piece is coaxially joined to an upper end of the concrete filled tube piece. The above-mentioned steps from the beam joining step to the tube piece joining step are repeated a plurality of times, whereby the prestress in each of the tube pieces counteracts a stress resulting from a compressive load exerted to the tube piece by the joined tube pieces, resulting in the construction of a concrete filled steel tube column in which the steel tube has substantially no axial stress.

A still further aspect of the present invention is directed to another method of constructing a concrete filled steel tube column. A steel tube piece is prepared. A separating layer is formed on an inner face of the tube piece so that the tube piece is not bonded to concrete that is to be charged in to the tube piece. The tube piece is erected on a foundation with its lower end spaced apart from the foundation so that a ring-shaped gap is formed between the lower end of the tube piece and the foundation. After the erecting of the tube piece, beams of the structure are joined to the tube piece. After the formation of the separating layer and the erecting of the tube piece, the concrete is charged into the tube piece to form a concrete core within the tube piece, whereby the tube piece is axially slidable relative to the concrete core. After the charged concrete is cured, an axial tensile load is applied to the tube piece by pulling the tube piece downward to close the ring-shaped gap, whereby an axial stress is induced in the tube piece. After the application of the tensile load, the lower end of the tube piece is joined with the foundation so that the stress induced in the tube piece remains in the tube piece as an axial prestress. Another steel tube piece is prepared. A separating layer is formed on an inner face of said another tube piece so that the tube piece is not bonded to concrete that is to be charged in to the tube piece. After the joining of the lower end of the tube piece and the foundation, said another tube piece is coaxially placed on the concrete filled tube piece with the adjacent ends of both the tube pieces spaced apart so that a ring-shaped gap is formed between their adjacent ends. After the placement of said another tube piece, the concrete-charging step and the load-applying step are repeated. Subsequently, the lower end of the tube piece is joined with the upper end of the lower adjoined tube piece so that the stress induced in the tube piece remains in the tube piece as an axial prestress. The fore-mentioned steps from the preparing step of said another tube piece to the joining step of the tube pieces are repeated a plurality of times, whereby the prestress in each of the tube pieces counteracts a stress resulting from a compressive load exerted on the tube piece by the joined tube pieces, resulting in the construction of a concrete filled steel tube column in which the steel tube has substantially no axial stress.

DETAILED DESCRIPTION OF THE PREFERRED EMBODIMENTS

Figure 1:
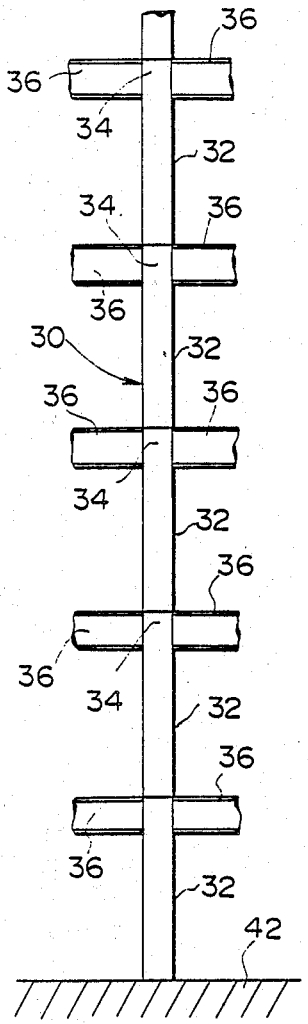
FIG. 1 is a front view of a concrete filled steel tube column according to the present invention.

In the drawings, like reference characters designate corresponding parts throughout views, and descriptions of the corresponding parts are omitted after once given.

Figure 2:
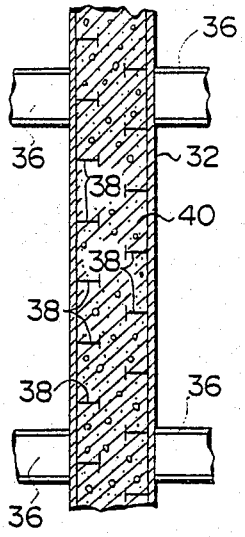
FIG. 2 is an enlarged fragmentary front view partly in section, of the concrete filled steel tube column in FIG. 1.

FIG. 1 illustrates a concrete filled steel tube column according to the present invention. This column is erected on a foundation 42 and constitutes a part of the framework of a building structure. This column has a steel tube 30 including a plurality of prestressed steel tube pieces 32 concentrically joined in series. Each of the tube pieces 32 has an upper end portion 34 as a joint portion to which horizontal beams 36 are joined. As shown in FIG. 2, each tube piece 32 also has a plurality of anchor bolts 38 welded at their one ends to the inner face of each tube piece 32. Within the tube pieces 32, a concrete core 40 is disposed for bearing an axial compressive load. In other words, the anchor bolts 38 project radially inwards and are embedded in the concrete core 40 to transfer the axial compressive load from the beams 36 to the core 40.

As described above, each of the tube pieces 32 is a prestressed tube piece into which an axial prestress is introduced. This prestress in each tube piece 32 counteracts a stress resulting from the compressive load transferred from the beams 36 to the steel tube 30. Accordingly, the steel tube 30 has substantially no axial stress induced in it, even though the axial compressive load is exerted on it. In order to introduce the prestress into the tube pieces 32, the concrete core 40 is subjected to an axial compression other than its own weight and the compressive load transferred from the beams 36 to the core 40. That is to say, the concrete core 40 applies an axial tension to the tube pieces 32 as a reaction to the compression exerted on it.

Figure 3:
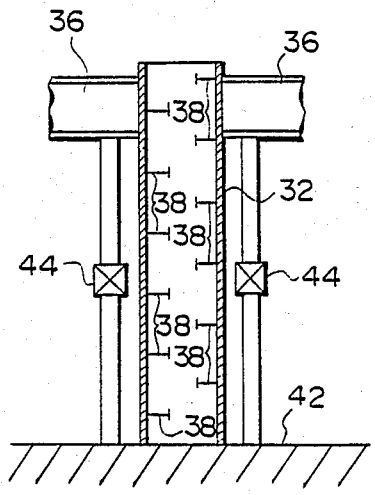
FIG. 3 is a vertical sectional view of a steel tube piece erected on a foundation, showing its upper end portion joined with beams.
Figure 4:
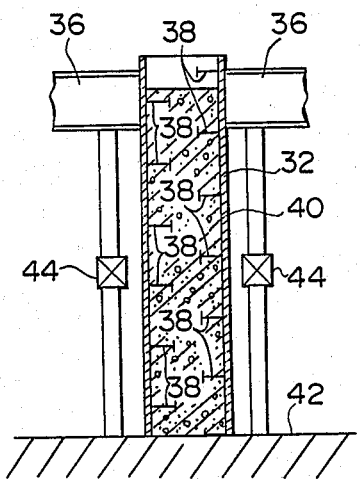
FIG. 4 is a vertical sectional view of the steel tube in FIG. 3, filled with concrete.
Figure 5:
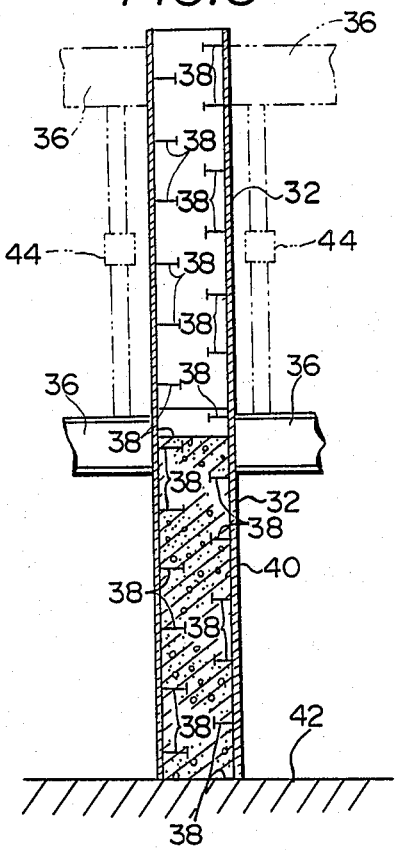
FIG. 5 is a vertical sectional view of the tube piece in FIG. 4 with its upper end joined with another tube piece.

FIGS. 3 to 5 illustrate a process for constructing the concrete filled steel tube column in FIG. 1. First of all, a steel tube piece 32 having a plurality of the anchor bolts 38 on its inner face is prepared. Then, as shown in FIG. 3, the tube piece 32 is erected on the foundation 42, and the beams 36 are joined to the upper end portion 34 of the tube piece 32. Next, jacks 44, such as hydraulic jacks and screw jacks, are set between the beams 36 and the foundation 42 at positions in close proximity to the tube piece 32. The jacks 44 are, then, vertically extended to a predetermined length in order to apply an axial tensile load to the tube piece 32, thereby inducing an axial stress in the steel tube. Preferably, the induced stress is such that the stress is dissipated by a counter stress caused by the axial compressive load that will be applied to each of the tube pieces 32 when the whole column is constructed. Thereafter, concrete is charged, as shown in FIG. 4, into the tube piece 32 to form the concrete core 40.

After the charged concrete is hardened, the jacks 44 are removed from their set positions releasing the tensile load from the tube piece 32. As a result, the tube piece 32 applies an axial compression via the anchor bolts 38 to the concrete core 40, and as a reaction to its application of the axial compression to the core 40, the tube piece 32 continues to undergo the axial tension. Therefore, the stress induced in the tube piece 32 remains in the tube piece as an axial prestress. After the release of the tensile load, as shown in FIG. 5, another tube piece 32 having a plurality of anchor bolts 38 is concentrically joined to the upper end of the concrete charged tube piece 32. Thereafter, the above-mentioned steps from the beam-joining step to the tube piece-joining step are repeated the predetermined amount of times. In other words, a plurality of prestressed concrete filled tube pieces are joined one by one, whereby the concrete core 40 is subjected to more and more compression and the prestress in the tube pieces 32 decreases gradually, resulting in the completion of a column in which the steel tube 30 has substantially no axial stress. Note that after the first tube joining step, the jacks 44 must be set, as shown by the phantom line in FIG. 5, between the beams 36 and beams 36 that is joined to the lower adjoined tube piece 32.

Figure 6:
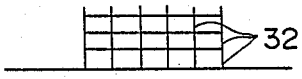
FIG. 6 is a schematic front view of a building structure under construction.
Figure 7:
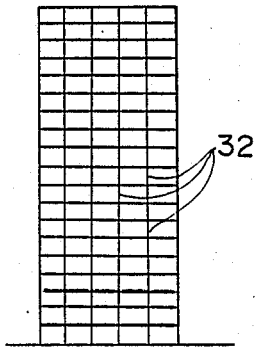
FIG. 7 is a schematic front view of the building structure in FIG. 6 after its completion.
Figure 8:
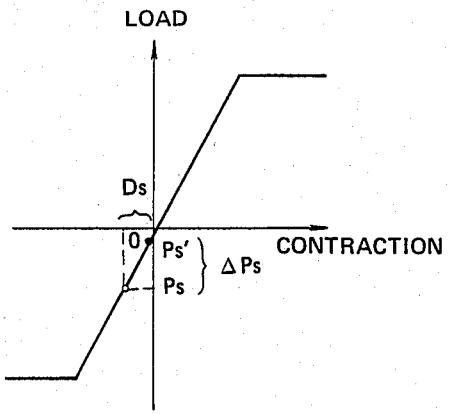
FIG. 8 is a load-contraction diagram of a steel tube in FIG. 1.
Figure 9:
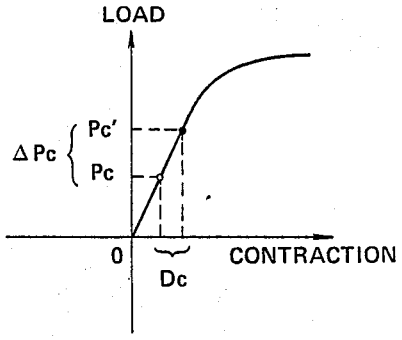
FIG. 9 is a load-contraction diagram of a concrete core in FIG. 2.

FIGS. 6 to 9 diagrammatically illustrate the relationship of the load applied to the steel tube 30 and the load applied to the concrete core 40 both before and after the construction of the building structure. Specifically, FIG. 6 shows a building structure under construction, in which the column in FIG. 1 is used as a part of the framework of the structure. FIG. 7 shows a constructed building structure of the same. FIG. 8 shows a load-contraction curve of the steel tube 30, and FIG. 9 shows a load-contraction curve of the concrete core 40. If the steel tube piece 30 in FIG. 6 undergoes the tensile load Ps indicated in FIG. 8, the concrete core 40 in FIG. 6 undergoes the compressive load Pc indicated in FIG. 9, which is equal to the tensile load Ps. On the other hand, during the construction of the structure, if the steel tube 30 is axially contracted a decrease in length Ds resulting, the steel tube 30 in FIG. 7 undergoes a tensile load Ps' indicated in FIG. 8. Also, the core 40 in FIG. 7 undergoes a compressive load Pc' indicated in FIG. 9, because of the decrease in length Dc during the construction. The contracted length Ds is equal to the contracted length Dc. According to FIGS. 8 and 9, it is understood that the load P that is applied to the column during the construction is represented by the following formula:

$$P=\Delta Ps+\Delta Pc$$

where ΔPs is a difference between Ps and Ps', and ΔPc is a difference between Pc and Pc'. It is also understood that in the state of FIG. 7, only the concrete core 40 bears the axial compressive load applied by the building structure.

Accordingly, if the proper degree of prestress is given to each of the tube pieces 32, axial stress resulting from the weight of the building structure is not induced in the steel tube 30 after the completion of the structure, but circumferential stress is induced in it due to a transverse strain of the concrete core 40. Therefore, in view of Mieses's yield conditions, it is expected to efficiently enhance the concrete core in compressive strength by the lateral confinement of the steel tube. As a result, the compressive strength of the core is efficiently enhanced, thereby enabling a reduction in the cross-section of the column.

Furthermore, since the tube pieces 32 are joined in series to form a steel tube 30, the column has a rigidity resistant to an axial compressive or tensile load. Accordingly, the steel tube 30 and the core 40 move in singular alignment when a short-time loading caused by, for example, an earthquake, is exerted on the column. In other words, the column according to FIG. 1 has a rigidity and a resistance as good as the conventional column.

Note that another process may be employed for constructing the steel tube column in FIG. 1. In accordance with this process, a plurality of concrete filled steel tube pieces are prepared in a factory. Each of the concrete filled steel tube pieces is produced as follows: A steel tube piece 32 having many anchor bolts 38 is prepared, then, an axial tensile load is applied to the tube piece 32 by using, for example, jacks 44. Subsequently, concrete is charged into the tube piece 32 to form a concrete core 40; After the charged concrete is cured, the tensile load is released from the tube piece 32, thereby an axial prestress is introduced into the tube piece 32. The concrete steel tube pieces thus prepared are transported from the factory to a construction site, and there concentrically joined one by one to form a column. In this case, each of the concrete filled steel tube pieces has a cylindrical space defined at its one or opposite end portions, which is not occupied by the concrete. The space is filled with a filler such as mortar in joining the corresponding tube piece to another tube piece.

In the fore-mentioned embodiment, the tube pieces 32 are joined in series one by one during the construction, however, a plurality of pairs of the tube pieces 32, each pair of the tube pieces coaxially joined together, may be joined one after another instead. The concrete core 40 may be enhanced in its tensile and compressive strength by embedding reinforcing bars in it or by introducing prestress in it. The prestress may be introduced by disposing sheath pipes in the steel tube, by charging concrete into the tube, by inserting Pc steel rods into the sheath pipes, by applying tension to the PC rods, and then by filling the sheath pipes with mortar.

Figure 10:
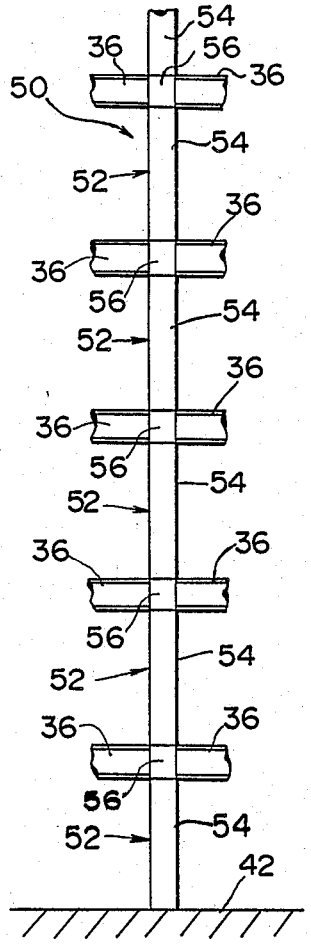
FIG. 10 is a front view of another embodiment according to the present invention.
Figure 11:
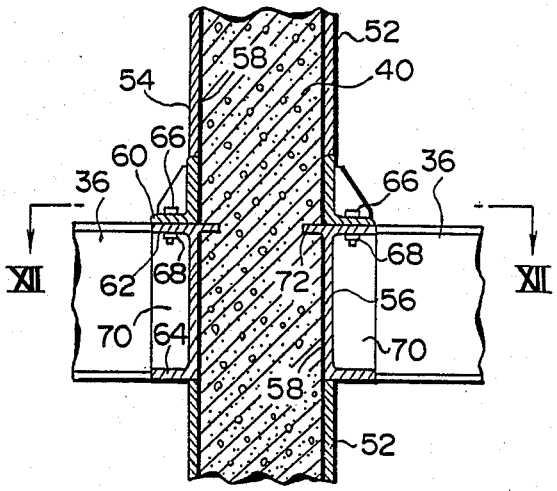
FIG. 11 is an enlarged fragmentary front view, partly in section, of the concrete filled steel tube column in FIG. 10.
Figure 12:
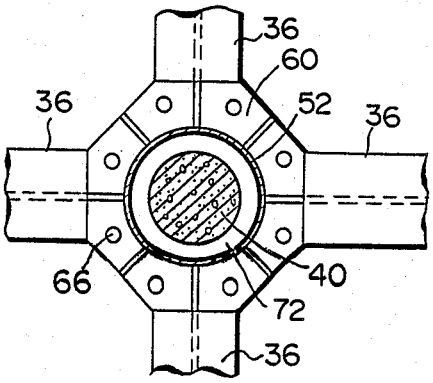
FIG. 12 is a view taken along the line XII—XII in FIG. 11.

FIGS. 10 to 12 illustrate another embodiment according to the present invention. In FIG. 10, a plurality of prestressed tube pieces 52 are coaxially joined in series to form a steel tube 50 having substantially no axial stress. Each of the prestressed tube pieces 52 includes a tube body 54, and a joint tube 56 which is coaxially welded to the upper end of the tube body 54 to form a joint portion of the tube piece 52. As shown in FIG. 11, a separating layer 58 is interposed between the steel tube and the concrete core 40. The separating layer 58 is made of a material such as asphalt, oil, grease, paraffin wax, petrolatum, synthetic resin and paper. The thickness of the separating layer 58 is such that it provides a viscous slip to the concrete core 36. In asphalt, the thickness is about 20–100$\mu$.

The tube body 54 has an outer flange 60 formed around its lower end. The joint tube 56 has a pair of joint flanges 62 and 64 formed around its opposite ends. The outer flange 60 of each tube piece 52 is fastened to the upper joint flange 62 of the lower adjoined tube piece 52 by a plurality of bolts 66 and nuts 68. As shown in FIG, 12, four webs 70 are provided between the opposite joint flanges 62 and 64 of the joint tube 56 at 90° angular intervals for joining the beams 36 to the joint tube 56. The joint tube 56 also has an inner flange 72 circumferentially welded on its inner face at the same level as the upper joint flange 62. This inner flange 72 projects radially inward into the concrete core 40 to transfer the axial load between the steel tube 50 and the core 40.

Figure 13:
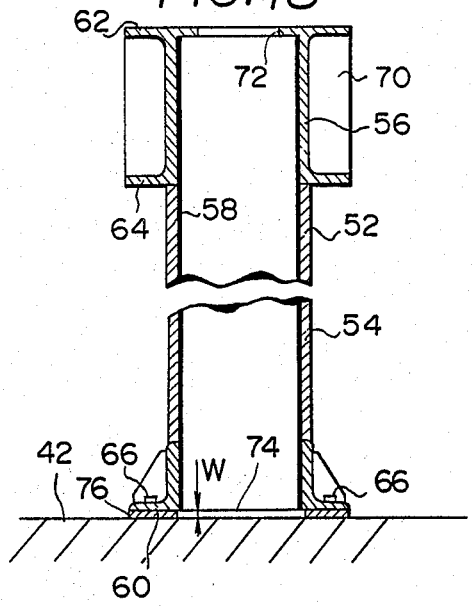
FIG. 13 is a vertical sectional view of a tube piece erected with its lower end spaced apart from the foundation.
Figure 14:
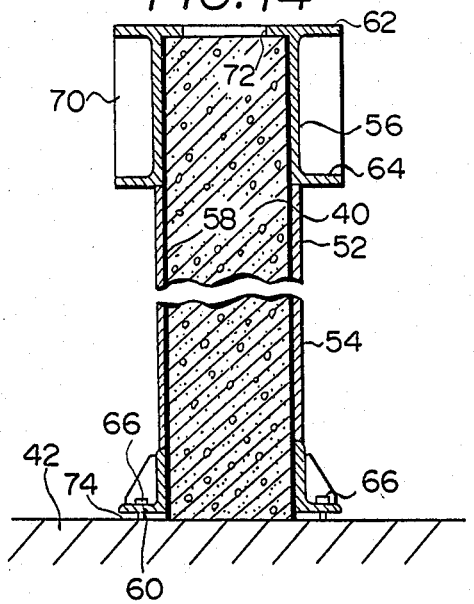
FIG. 14 is a vertical sectional view of the tube piece in FIG. 13, filled with concrete.
Figure 15:
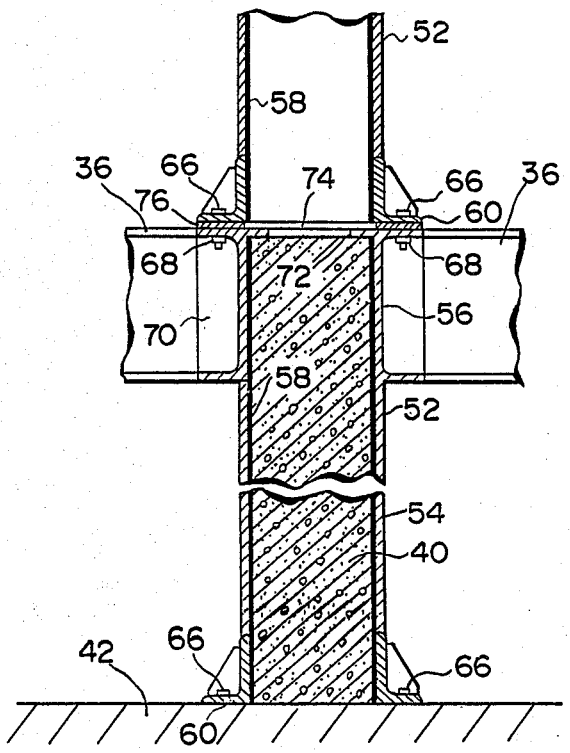
FIG. 15 is a vertical sectional view of the tube piece in FIG. 14 with its upper end joined with another tube piece.

FIGS. 13 to 15 show a process for constructing the concrete filled steel tube column in FIG. 10. At first, the tube piece 52 is prepared, and a separating material is applied over the inner face of the tube piece 52 to form the separating layer 58. The tube piece 52 is produced by joining a joint tube 56 concentrically to the upper end of a tube body 54. Then, as shown in FIG. 13, the tube piece 52 having the separating layer 58 is erected on the foundation 42 with its lower end spaced apart from the foundation 42 so that a ring-shaped gap 74 is formed between the tube piece 52 and the foundation 42. The ring-shaped gap 74 is produced by inserting a ring-shaped spacer 76 between the outer flange 60 of the tube piece 52 and the foundation 42. The width W of the ring-shaped gap 74 is such that it introduces a prestress into the tube piece 52, this prestress being dissipated by counteracting a stress resulting from the weight of the building structure when the building is constructed. Next, the bolts 66 are passed through both the outer flange 60 and a bracket (not shown) of the foundation 42 and following this, the nuts 68 are engaged with the bolts 66. Thereafter, concrete is charged into the tube piece 52 to form the concrete core 40, and the concrete is hardened. The concrete core 40 thus formed is not bonded to the tube piece 52, and therefore the tube piece is axially slidable relative to the concrete core 40. Next, as shown in FIG. 14, the spacer 76 is removed from the gap 74 and the bolts 66 are tightened with their corresponding nuts 68, so that the tube piece 52 is pulled and slid downward until the gap 74 is closed. When the bolts 66 are tightened, an axial compression is transferred from the tube piece 52 to the concrete core 40 via the inner flange 72. Hence, the tube piece 52 undergoes an axial tension as a reaction to the application of the compression to the core 40. As a result, the tube piece 52 is introduced with a prestress as well as being attached at its lower end to the foundation 42 by the bolt-and-nut connections. As shown in FIG. 15, after tightening the bolts 66, the beams 36 are joined to the joint portion, i.e., the joint tube 56 of the tube piece 52, and then another tube piece 52 having the separating layer 58 on its inner face is concentrically placed on the concrete filled tube piece 52 with the adjacent ends of both the tube pieces 52 and 52 spaced apart. Naturally, a ring-shaped gap 74 is formed between the adjacent ends of both the tube pieces 52 and 52. Thereafter, the fore-mentioned steps from the concrete-charging step to the tube piece-placing step are repeated the predetermined amount of times, whereby a plurality of prestressed concrete filled tube pieces are joined one by one, and finally there is constructed the column in which the steel tube 50 has substantially no axial stress. Note that, after the first tube-placing step, the bolts 66 are passed through both the outer flange 60 and the upper joint flange 62, and also by tightening the bolts 66, the tube piece 52 is attached at its lower end to the upper end of the lower adjoined tube piece 52.

Figure 16:
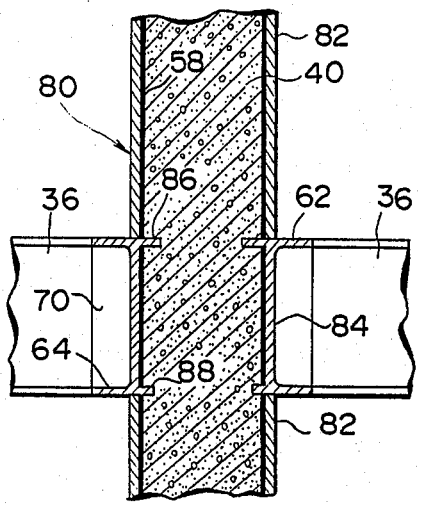
FIG. 16 is a fragmentary front view partly in section, of a modified form of the concrete filled steel tube column in FIG. 11.

A modified form of the column in FIGS. 10 to 12 is illustrated in FIG. 16, in which a joint tube 84 has a pair of inner flanges 86 and 88, and the lower end of each tube piece 82 is welded to the lower adjoined tube piece 82.

Figure 17:
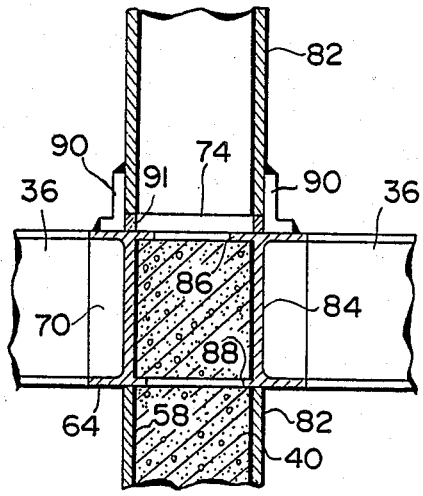
FIG. 17 is a front view, partly in section, of the connected section between two tube pieces, showing L-shaped supporting brackets attached to this section for the forming of a gap between the two tube pieces.
Figure 18:
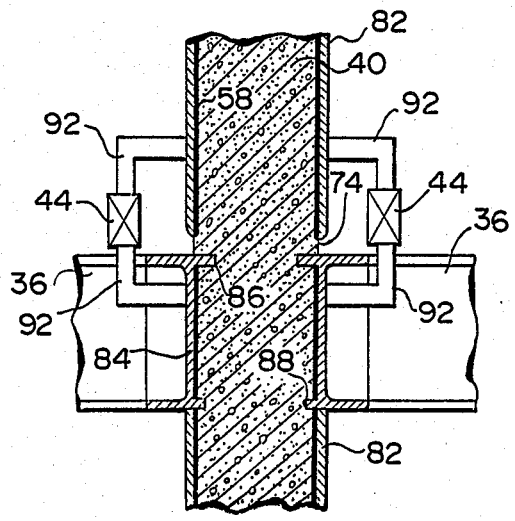
FIG. 18 is a front view, partly in section, of the connected section in FIG. 17, showing jacks attached to both the two tube pieces.

In constructing the column in FIG. 16, the tube piece 82 is prepared, and the separating layer 58 is formed on the inner face of the tube piece 82. Then, as shown in FIG. 17, the tube piece 82 is placed upright on the upper end of a concrete filled tube piece 82 which has been erected beforehand, with the adjacent ends of both the tube pieces 82 spaced apart so that a ring-shaped gap 74 is formed between their adjacent ends. The ring-shaped gap 74 is formed by interposing a plurality of L-shaped supporting brackets 90 between both the tube pieces 82. These supporting brackets 90 are attached at their upper ends to the outer face of the tube piece 82, and are attached at their lower ends to the upper joint flange 62 of the lower adjoined tube piece, thus supporting the upper tube piece 82 above it. Then, a filler 91, made of moldable material, such as asphalt, rubber and lead, is filled within the gap 74. Next, concrete is charged into the tube piece 82, and cured. Then, the supporting brackets 90 are detached from both tube pieces 82, and the filler 91 is removed from the gap 74. Subsequently, as shown in FIG. 18, jacks 44 are set between both tube pieces 82. These jacks 44 are attached to both tube pieces 82 via joint arms 92. Then, the tube piece 52 is pulled downward by using the jacks 44 in order for it to slide downward until the gap 74 is eliminated. Thereafter, the lower end of the upper tube piece 82 is welded to the upper end of the lower adjoined tube piece 82, and the jacks 44 are removed from their set positions. Then, the beams 36 are joined to the joint tube 84 of the welded tube piece 82. After that, the fore-mentioned steps are repeated the predetermined amount of times, whereby a plurality of prestressed concrete filled tube pieces are joined one by one, and finally there is constructed the column in which the steel tube 80 has substantially no axial stress.

Figure 19:
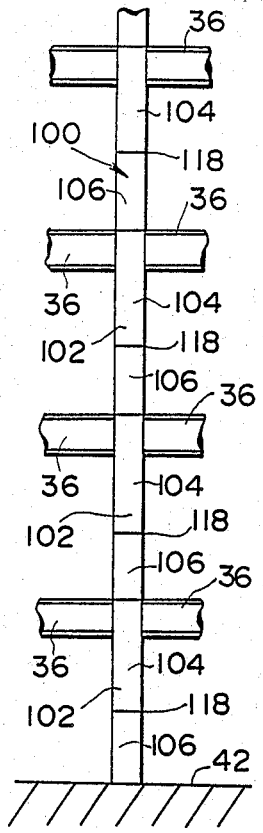
FIG. 19 is a front view of a further embodiment according to the present invention.
Figure 20:
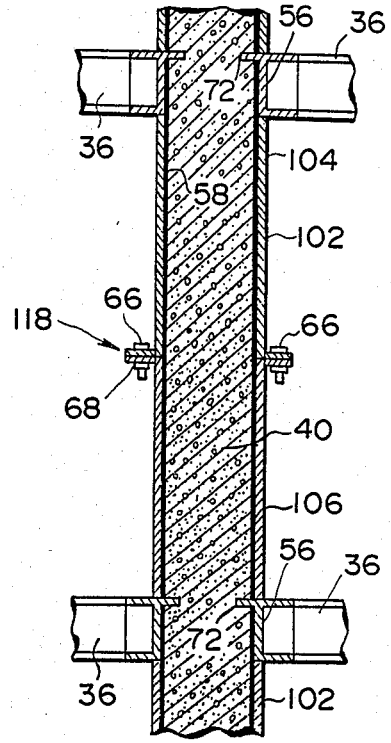
FIG. 20 is an enlarged fragmentary front view, partly in section, of the concrete filled steel tube column in FIG. 19.

FIGS. 19 and 20 show a further embodiment according to the present invention. In FIG. 19, a plurality of tube pieces 102 are joined in series to form a steel tube 100. This steel tube 100 also has substantially no axial stress, even though it is subjected to the axial compressive load due to the weight of the building structure. Each of the tube pieces 102 includes an upper tube body 104 having its upper end portion formed by the joint tube 56, and a lower tube body 106 coaxially joined to the lower end of the upper tube body 104. The upper tube body 104, as the upper portion of the tube piece 102, has an outer flange 108 formed around its lower end, and the lower tube body 106, as the lower portion of the tube piece 102, has an outer flange 110 formed around its upper end. The outer flange 108 of the upper tube body 104 is fastened to the outer flange 110 of the lower tube body 106 by a plurality of pairs of bolts 66 and nuts 68. In other words, the tube piece 102 has a connection 118 between the tube bodies 104 and 106 at its inflection point of moment. Also, a separating layer 58 is interposed between the steel tube 100 and the concrete core 40.

Figure 21:
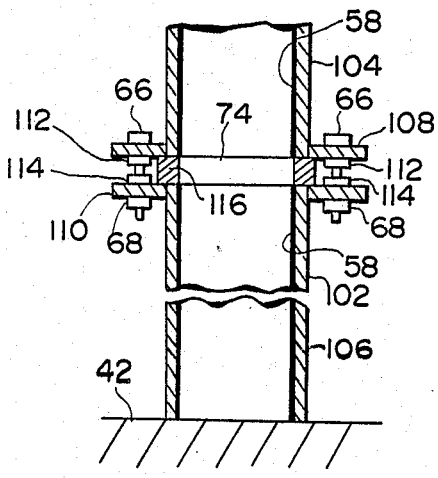
FIG. 21 is a fragmentary vertical sectional view of a tube piece erected on the foundation, a ring-shaped gap formed in its middle portion.
Figure 22:
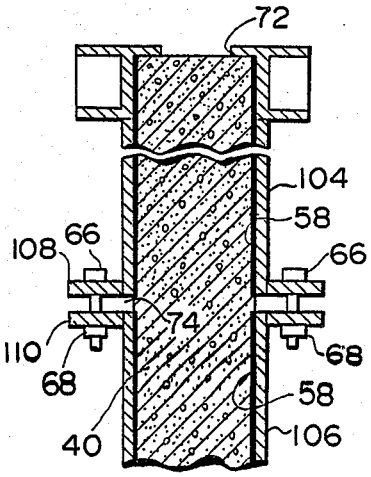
FIG. 22 is a fragmentary vertical sectional view of the tube piece in FIG. 21, filled with concrete.

FIGS. 21 and 22 illustrate a process for constructing the concrete filled steel tube column in FIG. 19. First of all, the upper and lower tube bodies 104 and 106 are prepared, and a separating layer 58 is formed on the inner face of both the tube bodies 104 and 106. Then, as shown in FIG. 21, the upper tube body 104 is concentrically connected to the lower tube body 106 with their adjacent ends spaced apart so that a ring-shaped gap 74 is formed between the upper and lower tube bodies 104 and 106. This connection is achieved by passing a plurality of bolts 66 through both the outer flange 108 of the upper tube body 104 and the outer flange 110 of the lower tube body 106 and by engaging the nuts 68 with the bolts 66. In order to maintain the gap 74 between the upper and lower bodies 104 and 106, a pair of nuts 112 and 114 are screwed onto that portion of each bolt 66 extending between both the outer flange 108 and 110. Next, a filler 116 made of moldable material is filled within the gap 74, and the tube piece 102 having a gap 74 is erected on the foundation 42. After that, concrete is charged, as shown in FIG. 22, into the tube piece 102 and then concrete is hardened. Naturally, the concrete core 40 thus formed is not bonded to the tube piece 102. Thereafter, the pair of nuts 112 and 114 are unscrewed from each of the bolts 66, and the filler 116 is removed from the gap 74. Then the bolts 66 are tightened with their corresponding nuts 68 so that the upper and lower tube bodies 104 and 106 are pulled and slid toward each other until the gap 74 is eliminated. As a result, the tube piece 102 is subjected to an axial tension, i.e., the axial prestress as a reaction to the application of the compression to the core 40, and also the upper tube body 104 is fastened to the lower tube body 106 by the bolt-and-nut connections. After tightening the bolt 66, the beams 36 are joined to the joint tube 56 of the tube piece 102, and another tube piece 102 having a separating layer 58 and a gap 74 is coaxially welded to the upper end of the concrete filled tube piece 102 Thereafter, the above-described steps from the concrete-charging step to the tube piece-welding step are repeated the predetermined amount of times, whereby there is constructed a column in which the steel tube 100 has substantially no axial stress.

In order to maintain the gap 74 between the upper and lower bodies 104 and 106, grout, such as epoxy resin, cement paste and a lead plate, may be filled in the gap 74 in place of the pair of nuts 112 and 114. The upper tube body 104 may be connected to the lower tube body 106 with both their adjacent ends spaced apart after the lower tube body 106 is erected or welded to the lower concrete filled tube piece 102.

Figure 23:
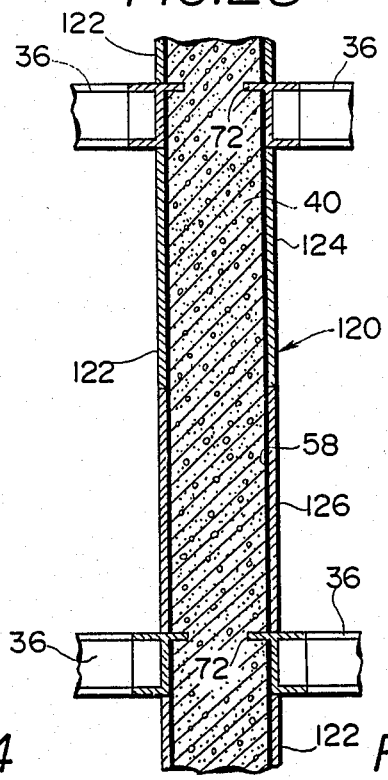
FIG. 23 is a fragmentary front view, partly in section, of a modified form of the concrete filled steel tube column in FIG. 19.

A modified form of the concrete filled steel tube column in FIGS. 19 and 20 is illustrated in FIG. 23, in which each of tube pieces 122 includes an upper tube body 124, and a lower tube body 126 coaxially welded to the lower end of the upper tube body 124.

Figure 24:
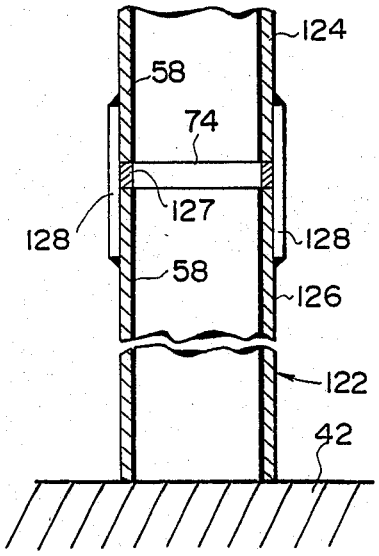
FIG. 24 is a fragmentary vertical sectional view of a tube piece erected on the foundation, showing a ring-shaped gap formed in its middle portion.
Figure 25:
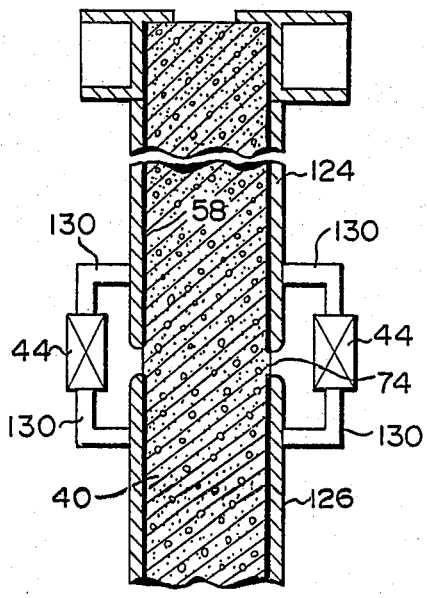
FIG. 25 is a fragmentary vertical sectional view of the tube piece in FIG. 24, filled with concrete, jacks attached to both its upper and lower portions.

In constructing the column in FIG. 23, the upper and lower tube bodies 124 and 126 are prepared, and a separating layer 58 is formed on the inner face of both the tube bodies 124 and 126. Then, as shown in FIG. 24, the upper body 124 is coaxially connected to the lower body 126 with the adjacent ends of the upper and lower bodies spaced apart, thus forming a gap 74 between their adjacent ends. This connection is accomplished by interposing a plurality of supporting brackets 128 between the upper and lower tube bodies 124 and 126. These supporting brackets 128 are attached at their upper ends to the outer face of the upper tube body 124, and are attached at their lower ends to the outer face of the lower tube body 126, thereby maintaining the gap 74 between the upper and lower bodies 124 and 126. Next, a filler 127, made of moldable material is filled within the gap 74, and the tube piece 122 which has a gap is erected on the foundation 42. Then, as shown in FIG. 25, concrete is charged into the tube piece 122. After the concrete is cured, the supporting brackets 128 are detached from both the upper and lower tube bodies 124 and 126, and the filler 127 removed from the gap 74. Subsequently, as shown in FIG. 25, jacks 44 are attached to both the upper and lower tube bodies 124 and 126 via joint arms 130. Next, both the upper and lower tube bodies 124 and 126 are pulled toward each other by using the jacks 44 in order for them to slide toward each other until the gap is closed. Then, the lower end of the upper body 124 is welded to the upper end of the lower body 126, and the jacks 44 are removed from their set positions. Thereafter, the beams 36 are joined to the joint tube 56 of the tube piece 122, and another tube piece 122 having a separating layer 58 and a gap 74 is coaxially welded to the upper end of the concrete filled tube piece 122. Next, the above-mentioned steps from the charging step to the tube piece-welding step are repeated the predetermined amount of times.

Instead of preparing the two tube bodies 124 and 126, one whole tube piece may be prepared, and the gap 74 may be formed by dividing the whole tube piece into two tube bodies. In this case, the tube piece may be divide either before or after the erecting of the tube piece or even after the hardening of the charged concrete.

Instead of the above-mentioned process, another process may be employed for constructing the concrete steel tube column in FIG. 23. In a factory, there are prepared a plurality of concrete filled steel tube pieces in each of which the tube piece 122 has a gap 74 formed between the upper and lower tube bodies 124 and 126. After that, the concrete filled steel tube pieces are transported from the factory to a construction site, and there, coaxially joined one by one to form a column. In this case, each concrete filled tube piece has a cylindrical space defined at its one or opposite end portions, which is not occupied by concrete. Therefore, in joining the tube pieces 122, the space is filled with a filler such as mortar in order to join the cores 40 of the concrete filled tube pieces. The gap 74 may be closed after the joining of the tube pieces 122. This process may also be applied for constructing the column in FIG. 19.

Still another process may be employed for constructing the column in FIG. 23. The upper and lower tube bodies 124 and 126 are prepared, and a separating layer 58 is formed on the inner face of both the upper and lower tube bodies 124 and 126. Next, the lower body 126 is erected on the foundation, and the upper body 124 is concentrically placed on the lower body 126 with the adjacent ends of the upper and lower bodies spaced apart, thus forming a gap 74 between the adjacent ends. The way to form the gap 74 may be the same as the way shown in FIG. 24. Next, the beams 36 are joined to the joint tube 56 of the upper tube body 124, and then concrete is charged into both the upper and lower tube bodies 124 and 126, that is, into the tube piece 122. After the concrete is cured, the supporting brackets 128 and the filler 127 are removed from the tube piece 122. Then, another lower tube body 126 is welded to the upper end of the concrete filled tube piece 122. Thereafter, the above-mentioned steps from the upper body-placing step to the lower body-welding step are repeated the predetermined amount of times in order to join a plurality of the concrete filled tube pieces one by one. In joining the concrete filled tube pieces one by one, the concrete core 40 is subjected to more and more axial compressive load. Therefore, the core 40 reduces its axial length, and hence the tube pieces 122 slide downward, eliminating the gaps 74 in the tube pieces 122. Finally, the upper tube body 124 of each tube piece 122 is welded together with its corresponding lower tube body 126, whereby there is constructed a concrete filled steel tube column in which the steel tube 120 has substantially no axial stress. This process may be applied for constructing not only the column in FIG. 23 but also the columns in FIGS. 10, 16 and 19.

It is understood that although preferred embodiments of the present invention have been shown and described, various modifications thereof will be apparent to those skilled in the art, and, accordingly, the scope of the present invention should be defined only by the appended claims and equivalents thereof.

What is claimed is:

1. In a concrete filled steel tube column which constitutes a part of the framework of a structure, the steel tube column including: a steel tube connected to beams of the structure so that an axial compressive load is transferred from the beams and applied to the steel tube; and a concrete core, disposed within the steel tube, for bearing an axial compressive load transferred from the beams via the steel tube to the concrete core, the improvement wherein the steel tube comprises a plurality of prestressed tube pieces concentrically joined in series, each tube piece having an axial tensile prestress introduced thereinto to counteract a compressive stress resulting from said compressive load applied to the steel tube, whereby substantially no axial stress is induced in the steel tube, and wherein the concrete core is held under an axial compression, in addition to said axial compressive load, said axial compression of the core applying said prestress to each of the tube pieces.

2. A concrete filled steel tube column as recited in claim 1, wherein each of the tube pieces has load transfer means, mounted on an inner face thereof, for transferring the axial load between the steel tube and the concrete core.

3. A concrete filled steel tube column as recited in claim 2, wherein the load transfer means comprises a plurality of projection members, each projecting radially inward from the inner face of the corresponding tube piece.

4. A concrete filled steel tube column as recited in claim 2, wherein each of the tube pieces has a joint portion to which the beams of the structure are joined, and wherein the load transfer means comprises an inner flange circumferentially formed on the inner face of the joint portion, the inner flange projecting radially inward.

5. A concrete filled steel tube column as recited in claim 4, further comprising a separating layer interposed between the steel tube and the concrete core, for separating the core from the steel tube so that the steel tube is not bonded to the core.

6. A concrete filled steel tube piece for use in a structural column, comprising: a steel tube piece having an axial tensile prestress introduced thereinto; and a concrete core disposed within the tube piece so that an axial load is transferred between the tube piece and the concrete core, the concrete core being under an axial compression to maintain the prestress in the tube piece, said axial compression being a reaction to the introduction of the prestress into the tube piece.

7. A concrete filled steel tube piece as recited in claim 6, wherein the tube piece has load transfer means, mounted on an inner face thereof, for transferring the axial load between the tube piece and the concrete core.

8. A concrete filled steel tube piece as recited in claim 7, wherein the load transfer means comprises a plurality of projection members, each projecting radially inward from the inner face of the tube piece.

9. A method of constructing a concrete filled steel tube column comprising the steps:

(a) preparing a steel tube piece;
(b) erecting the tube piece;
(c) after the erecting step, joining beams to the tube piece;
(d) applying an axial tensile load to the tube piece so that an axial stress is induced in the tube piece;
(e) after the load applying step, charging concrete into the tube piece to form a concrete core within the tube piece;
(f) after the charged concrete is cured, releasing the tensile load from the tube piece so that the concrete core is subjected to an axial compression as a reaction to the application of an axial tension to the tube piece, whereby the stress induced in the tube piece remains in the tube piece as an axial prestress;
(g) preparing another steel tube piece;
(h) coaxially joining said another tube piece to an upper end of the concrete filled tube piece; and thereafter
(i) repeating the steps (c) to (i), whereby the prestress in each of the tube pieces counteracts a stress resulting from a compressive load exerted on the tube piece by the joined tube pieces, resulting in the construction of a concrete filled steel tube column in which the steel tube has substantially no axial stress.

10. A method as recited in claim 9, wherein each of the steps (a) and (g) comprises the step:

(j) mounting a load transfer means on an inner face of the tube piece for transferring the axial load between the steel tube and the concrete core.

11. A method of constructing a concrete filled steel tube column comprising the steps in the order described:

(k) preparing a plurality of concrete filled steel tube pieces, each including a steel tube piece having an axial prestress introduced thereinto, and a concrete core disposed within the tube piece, the concrete core being under an axial compression as a reaction to the application of an axial tension to the tube piece to introduce the prestress into the tube piece;
(l) erecting one of the concrete filled tube pieces;
(m) joining beams to the concrete filled tube piece;
(n) coaxially joining another concrete filled tube piece to an upper end of the concrete filled tube piece to which the beams are joined; and (o) repeating the steps (m) to (o), whereby the prestress in each of the tube pieces counteracts a stress resulting from a compressive load exerted on the tube piece by the joined concrete filled steel tubes, resulting in the construction of a concrete filled steel tube column in which the steel tube has substantially no axial stress.

12. A method as recited in claim 11, wherein the step (k) comprises the steps in the order described:

(p) preparing a steel tube piece;

(q) applying an axial tensile load to the tube piece so that an axial stress is induced in the tube piece;

(r) charging concrete into the tube piece to form a concrete core within the tube piece; and (s) after the charged concrete is cured, releasing the tensile load from the tube piece so that the concrete core is subjected to an axial compression as a reaction to the application of an axial tension to the tube piece, whereby the stress induced in the tube piece remains in the tube piece as an axial prestress.

13. A method as recited in claim 12, wherein the step (p) comprises the step:

(t) mounting a load transfer means on an inner face of the tube piece for transferring the axial load between the steel tube and the concrete core.

14. A method of constructing a concrete filled steel tube column comprising the steps:

(A) preparing a steel tube piece;

(B) forming a separating layer on an inner face of the tube piece so that the tube piece is not bonded to concrete that is to be charged into the tube piece;

(C) erecting the tube piece;

(D) after the step (C), joining beams to the tube piece;

(E) forming a ring-shaped gap in the tube piece so that an upper portion of the tube piece is separated from a lower portion of the tube piece;

(F) after the steps (B) and (C), charging said concrete into the tube piece having the separating layer to form a concrete core within the tube piece, whereby the tube piece is axially slidable relative to the concrete core;

(G) preparing another steel tube piece;

(H) forming a separating layer on an inner face of said another tube piece so that the tube piece is not bonded to concrete that is to be charged into the tube piece;

(I) after the charged concrete is cured, coaxially joining said another tube piece to an upper end of the concrete filled tube piece;

(J) repeating the steps (D) to (J), whereby the concrete core is subjected to an axial compressive load, thereby reducing its axial length, resulting in a downward sliding movement of the tube pieces which eliminates the ring-shaped gaps in the tube pieces; and (K) finally, joining the upper portion of each of the tube pieces together with the lower portion of the corresponding tube piece, whereby there is constructed a concrete filled steel tube column in which the steel tube has substantially no axial stress.

15. A method as recited in claim 14, wherein each of the steps (A) and (G) comprises the step:

(L) mounting load transfer means on an inner face of the upper end portion of the tube piece for transferring the axial load between the steel tube and the concrete core.

16. A method of constructing a concrete filled steel tube column comprising the steps:

(M) preparing a steel tube piece;

(N) forming a separating layer on an inner face of the tube piece so that the tube piece is not bonded to concrete that is to be charged into the tube piece;

(O) erecting the tube piece on a foundation with a lower end of the tube piece spaced apart from the foundation so that a ring-shaped gap is formed between the lower end of the tube piece and the foundation;

(P) after the step (O), joining beams to the tube piece;

(Q) after the steps (N) and (O), charging said concrete into the tube piece having the separating layer to form a concrete core within the tube piece, whereby the tube piece is axially slidable relative to the concrete core;

(R) preparing another steel tube piece;

(S) forming a separating layer on an inner face of said another tube piece so that the tube piece is not bonded to concrete that is to be charged into the tube piece;

(T) after the charged concrete is cured, coaxially placing said another tube piece on the concrete filled tube piece with the adjacent ends of both the tube pieces spaced apart so that a ring-shaped gap is formed between their adjacent ends;

(U) after the step (T), repeating the steps (P) to (U), whereby the concrete core is subjected to an axial compressive load, thereby reducing its axial length, resulting in a downward sliding movement of the tube pieces which eliminates the ring-shaped gaps; and (V) finally, joining all the tube pieces in series and the lowermost tube piece together with the foundation, whereby there is constructed a concrete filled steel tube column in which the steel tube has substantially no axial stress.

17. A method as recited in claim 16, wherein each of the steps (M) and (R) comprises the step:

(W) mounting load transfer means on an inner face of the upper end portion of the tube piece for transferring the axial load between the steel tube and the concrete core.

18. A method of constructing a concrete filled steel tube column comprising the steps:

(i) preparing a steel tube piece;

(ii) forming a separating layer on an inner face of the tube piece so that the tube piece is not bonded to concrete that is to be charged in to the tube piece;

(iii) erecting the tube piece;

(iv) after the step (iii), joining beams to the tube piece;

(v) forming a ring-shaped gap in the tube piece so that an upper portion of the tube piece is separated from a lower portion of the tube piece;

(vi) after the steps (ii) and (iii), charging said concrete into the tube piece having the separating layer to form a concrete core within the tube piece, whereby the tube piece is axially slidable relative to the concrete core;

(vii) after the charged concrete is cured, applying an axial tensile load to the tube piece by pulling both the upper and lower portions of the tube piece toward each other to eliminate the ring-shaped gap, whereby an axial stress is induced in the tube piece;

(viii) after the step (vii), joining the upper portion of the tube piece together with the lower portion of the tube piece so that the stress induced in the tube piece remains in the tube piece as an axial prestress;

(ix) preparing another steel tube piece;

(x) forming a separating layer on an inner face of said another tube piece so that the tube piece is not bonded to concrete that is to be charged in to the tube piece;

(xi) after the step (viii), coaxially joining said another tube piece to an upper end of the concrete filled tube piece; and (xii) repeating the steps (iv) to (xii), whereby the prestress in each of the tube pieces counteracts a stress resulting from a compressive load exerted to the tube piece by the joined tube pieces, resulting in the construction of a concrete filled steel tube column in which the steel tube has substantially no axial stress.

19. A method as recited in claim 18, wherein each of the steps (i) and (ix) comprises the step:

(xiii) mounting load transfer means on an inner face of the upper end portion of the tube piece for transferring the axial load between the steel tube and the concrete core.

20. A method of constructing a concrete filled steel tube column comprising the steps:

(I) preparing a steel tube piece;

(II) forming a separating layer on an inner face of the tube piece so that the tube piece is not bonded to concrete that is to be charged in to the tube piece;

(III) erecting the tube piece on a foundation with a lower end of the tube piece spaced apart from the foundation so that a ring-shaped gap is formed between the lower end of the tube piece and the foundation;

(IV) after the step (III), joining beams to the tube piece;

(V) after the steps (II) and (III), charging said concrete into the tube piece having the separating layer to form a concrete core within the tube piece, whereby the tube piece is axially slidable relative to the concrete core;

(VI) after the charged concrete is cured, applying an axial tensile load to the tube piece by pulling the tube piece downward to eliminate the ring-shaped gap, whereby an axial stress is induced in the tube piece;

(VII) after the load applying step, joining the lower end of the tube piece with the foundation so that the stress induced in the tube piece remains in the tube piece as an axial prestress;

(VIII) preparing another steel tube piece;

(IX) forming a separating layer on an inner face of said another tube piece so that the tube piece is not bonded to concrete that is to be charged in to the tube piece;

(X) after the lower end joining step, coaxially placing said another tube piece on the concrete filled tube piece with their adjacent ends spaced apart so that a ring-shaped gap is formed between their adjacent ends;

(XI) after the step (X), repeating the steps (V) to (VI);

(XII) subsequently, joining the lower end of the tube piece with an upper end of the lower adjoined tube piece so that the stress induced in the tube piece remains in the tube piece as an axial prestress; and (XIII) repeating the steps (VIII) to (XIII), whereby the prestress in each of the tube pieces counteracts a stress resulting from a compressive load exerted on the tube piece by the joined tube pieces, resulting in the construction of a concrete filled steel tube column in which the steel tube has substantially no axial stress.

21. A method as recite in claim 20, wherein each of the steps (I) and (VIII) comprises the step:

(XIV) mounting load transfer means on an inner face of the upper end portion of the tube piece for transferring the axial load between the steel tube and the concrete core.

* * * * *